US007592979B2

(12) United States Patent
Hayama et al.

(10) Patent No.: US 7,592,979 B2
(45) Date of Patent: Sep. 22, 2009

(54) IMAGE DISPLAY APPARATUS AND TELEVISION APPARATUS

(75) Inventors: Akira Hayama, Atsugi (JP); Hideaki Yui, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 686 days.

(21) Appl. No.: 11/299,830

(22) Filed: Dec. 13, 2005

(65) Prior Publication Data

US 2006/0132394 A1 Jun. 22, 2006

(30) Foreign Application Priority Data

Dec. 17, 2004 (JP) ..... 2004-365532

(51) Int. Cl.
*G09G 3/22* (2006.01)

(52) U.S. Cl. ..... 345/75.2; 345/207; 345/55; 345/211

(58) Field of Classification Search ..... 345/75.2, 345/207, 55, 211
See application file for complete search history.

(56) References Cited

U.S. PATENT DOCUMENTS

| | | | | |
|---|---|---|---|---|
| 6,307,327 | B1 | 10/2001 | Xie et al. | 315/169.4 |
| 6,329,759 | B1 * | 12/2001 | Tanaka et al. | 315/169.3 |
| 6,822,628 | B2 * | 11/2004 | Dunphy et al. | 345/75.2 |
| 6,946,800 | B2 * | 9/2005 | Takeuchi et al. | 315/169.3 |
| 6,947,018 | B1 | 9/2005 | Yamazaki | 345/75.2 |
| 7,046,219 | B2 | 5/2006 | Kanai et al. | 345/75.2 |
| 2002/0167503 | A1 | 11/2002 | Tsunoda et al. | 345/204 |
| 2002/0171608 | A1 | 11/2002 | Kanai et al. | 345/55 |
| 2005/0105001 | A1 | 5/2005 | Yui et al. | 348/441 |
| 2005/0114901 | A1 | 5/2005 | Yui et al. | 725/100 |
| 2005/0125819 | A1 | 6/2005 | Ono et al. | 725/14 |
| 2005/0285543 | A1 | 12/2005 | Yui et al. | 315/169.4 |
| 2005/0286062 | A1 | 12/2005 | Yui | 358/1.9 |
| 2006/0066603 | A1 | 3/2006 | Obayashi et al. | 345/204 |

FOREIGN PATENT DOCUMENTS

| | | |
|---|---|---|
| JP | 11-024629 | 1/1999 |
| JP | 11-242457 | 9/1999 |
| JP | 11-250839 | 9/1999 |
| JP | 11-250840 | 9/1999 |
| JP | 2000-242214 | 9/2000 |
| JP | 2002-189440 | 7/2002 |

(Continued)

*Primary Examiner*—Richard Hjerpe
*Assistant Examiner*—Leonid Shapiro
(74) *Attorney, Agent, or Firm*—Fitzpatrick, Cella, Harper & Scinto

(57) ABSTRACT

An image display apparatus comprising: a plurality of pixels each having an electron emitting element and a light emitting area to be irradiated by electrons from the element; and a driving circuit for outputting a driving signal that drives the element, wherein the plurality of the light emitting areas include a plurality of light emitting areas that respectively emit light emitting colors differing from each other, wherein the circuit includes a correction circuit for correcting an input signal, and wherein the correction circuit executes a correction to the input signal for a predetermined electron emitting element based on a value obtained by adjusting a value corresponding to a quantity of electrons emitted from an electron emitting element proximate to the predetermined electron emitting element by a value corresponding to the light emitting color of the light emitting area of the pixel to which the proximate electron emitting element belongs.

6 Claims, 11 Drawing Sheets

FOREIGN PATENT DOCUMENTS

| | | |
|---|---|---|
| JP | 2003-29697 | 1/2003 |
| JP | 2003-036049 | 2/2003 |
| JP | 2003-536091 | 12/2003 |
| JP | 2004-240186 | 8/2004 |
| JP | 2006-106142 | 4/2006 |

* cited by examiner

FIG. 7A

| | | | | | | |
|---|---|---|---|---|---|---|
| 0 | 0 | 0 | 1 | 0 | 0 | 0 |
| 0 | 1 | 1 | 1 | 1 | 1 | 0 |
| 0 | 1 | 1 | 1 | 1 | 1 | 0 |
| 1 | 1 | 1 | 1 | 1 | 1 | 1 |
| 0 | 1 | 1 | 1 | 1 | 1 | 0 |
| 0 | 1 | 1 | 1 | 1 | 1 | 0 |
| 0 | 0 | 0 | 0 | 0 | 0 | 0 |

FIG. 7B

| | | | | | | |
|---|---|---|---|---|---|---|
| 0 | 0 | 0 | 1 | 0 | 0 | 0 |
| 0 | 1 | 1 | 1 | 1 | 1 | 0 |
| 0 | 1 | 1 | 1 | 1 | 1 | 0 |
| 1 | 1 | 1 | 1 | 1 | 1 | 1 |
| 0 | 1 | 1 | 1 | 1 | 1 | 0 |
| 0 | 0 | 0 | 0 | 0 | 0 | 0 |
| 0 | 0 | 0 | 0 | 0 | 0 | 0 |

FIG. 7C

| | | | | | | |
|---|---|---|---|---|---|---|
| 0 | 0 | 0 | 1 | 0 | 0 | 0 |
| 0 | 1 | 1 | 1 | 1 | 1 | 0 |
| 0 | 1 | 1 | 1 | 1 | 1 | 0 |
| 1 | 1 | 1 | 1 | 1 | 1 | 1 |
| 0 | 0 | 0 | 0 | 0 | 0 | 0 |
| 0 | 0 | 0 | 0 | 0 | 0 | 0 |
| 0 | 0 | 0 | 0 | 0 | 0 | 0 |

FIG. 7D

| | | | | | | |
|---|---|---|---|---|---|---|
| 0 | 0 | 0 | 0 | 0 | 0 | 0 |
| 0 | 0 | 0 | 0 | 0 | 0 | 0 |
| 0 | 0 | 0 | 0 | 0 | 0 | 0 |
| 1 | 1 | 1 | 1 | 1 | 1 | 1 |
| 0 | 1 | 1 | 1 | 1 | 1 | 0 |
| 0 | 1 | 1 | 1 | 1 | 1 | 0 |
| 0 | 0 | 0 | 1 | 0 | 0 | 0 |

FIG. 7E

| | | | | | | |
|---|---|---|---|---|---|---|
| 0 | 0 | 0 | 0 | 0 | 0 | 0 |
| 0 | 0 | 0 | 0 | 0 | 0 | 0 |
| 0 | 1 | 1 | 1 | 1 | 1 | 0 |
| 1 | 1 | 1 | 1 | 1 | 1 | 1 |
| 0 | 1 | 1 | 1 | 1 | 1 | 0 |
| 0 | 1 | 1 | 1 | 1 | 1 | 0 |
| 0 | 0 | 0 | 1 | 0 | 0 | 0 |

FIG. 7F

| | | | | | | |
|---|---|---|---|---|---|---|
| 0 | 0 | 0 | 0 | 0 | 0 | 0 |
| 0 | 1 | 1 | 1 | 1 | 1 | 0 |
| 0 | 1 | 1 | 1 | 1 | 1 | 0 |
| 1 | 1 | 1 | 1 | 1 | 1 | 1 |
| 0 | 1 | 1 | 1 | 1 | 1 | 0 |
| 0 | 1 | 1 | 1 | 1 | 1 | 0 |
| 0 | 0 | 0 | 1 | 0 | 0 | 0 |

FIG. 8A

| | | | | | | |
|---|---|---|---|---|---|---|
| 0 | 0 | 0 | 0 | 0 | 0 | 0 |
| 0 | 0 | 0 | 0 | 0 | 0 | 0 |
| 0 | 0 | 0 | 0 | 0 | 0 | 0 |
| 0 | 0 | 0 | 0 | 0 | 0 | 0 |
| 0 | 0 | 0 | 0 | 0 | 0 | 0 |
| 0 | 0 | 0 | 0 | 0 | 0 | 0 |
| 0 | 0 | 0 | 0 | 0 | 0 | 0 |

FIG. 8B

| | | | | | | |
|---|---|---|---|---|---|---|
| 0 | 0 | 0 | 0 | 0 | 0 | 0 |
| 0 | 0 | 0 | 0 | 0 | 0 | 0 |
| 0 | 0 | 0 | 0 | 0 | 0 | 0 |
| 0 | 0 | 0 | 0 | 0 | 0 | 0 |
| 0 | 0 | 0 | 0 | 0 | 0 | 0 |
| 0 | 0 | 0 | 0 | 0 | 0 | 0 |
| 0 | 0 | 0 | 1 | 0 | 0 | 0 |

FIG. 8C

| | | | | | | |
|---|---|---|---|---|---|---|
| 0 | 0 | 0 | 0 | 0 | 0 | 0 |
| 0 | 0 | 0 | 0 | 0 | 0 | 0 |
| 0 | 0 | 0 | 0 | 0 | 0 | 0 |
| 0 | 0 | 0 | 0 | 0 | 0 | 0 |
| 0 | 0 | 0 | 0 | 0 | 0 | 0 |
| 0 | 1 | 1 | 1 | 1 | 1 | 0 |
| 0 | 0 | 0 | 1 | 0 | 0 | 0 |

FIG. 8D

| | | | | | | |
|---|---|---|---|---|---|---|
| 0 | 0 | 0 | 0 | 0 | 0 | 0 |
| 0 | 0 | 0 | 0 | 0 | 0 | 0 |
| 0 | 0 | 0 | 0 | 0 | 0 | 0 |
| 0 | 0 | 0 | 0 | 0 | 0 | 0 |
| 0 | 1 | 1 | 1 | 1 | 1 | 0 |
| 0 | 1 | 1 | 1 | 1 | 1 | 0 |
| 0 | 0 | 0 | 1 | 0 | 0 | 0 |

FIG. 8E

| | | | | | | |
|---|---|---|---|---|---|---|
| 0 | 0 | 0 | 1 | 0 | 0 | 0 |
| 0 | 1 | 1 | 1 | 1 | 1 | 0 |
| 0 | 1 | 1 | 1 | 1 | 1 | 0 |
| 0 | 0 | 0 | 0 | 0 | 0 | 0 |
| 0 | 0 | 0 | 0 | 0 | 0 | 0 |
| 0 | 0 | 0 | 0 | 0 | 0 | 0 |
| 0 | 0 | 0 | 0 | 0 | 0 | 0 |

FIG. 8F

| | | | | | | |
|---|---|---|---|---|---|---|
| 0 | 0 | 0 | 1 | 0 | 0 | 0 |
| 0 | 1 | 1 | 1 | 1 | 1 | 0 |
| 0 | 0 | 0 | 0 | 0 | 0 | 0 |
| 0 | 0 | 0 | 0 | 0 | 0 | 0 |
| 0 | 0 | 0 | 0 | 0 | 0 | 0 |
| 0 | 0 | 0 | 0 | 0 | 0 | 0 |
| 0 | 0 | 0 | 0 | 0 | 0 | 0 |

FIG. 8G

| | | | | | | |
|---|---|---|---|---|---|---|
| 0 | 0 | 0 | 1 | 0 | 0 | 0 |
| 0 | 0 | 0 | 0 | 0 | 0 | 0 |
| 0 | 0 | 0 | 0 | 0 | 0 | 0 |
| 0 | 0 | 0 | 0 | 0 | 0 | 0 |
| 0 | 0 | 0 | 0 | 0 | 0 | 0 |
| 0 | 0 | 0 | 0 | 0 | 0 | 0 |
| 0 | 0 | 0 | 0 | 0 | 0 | 0 |

IMAGE DISPLAY APPARATUS AND TELEVISION APPARATUS

BACKGROUND OF THE INVENTION

1. Field of the Invention

The present invention relates to an image display apparatus and a television apparatus.

2. Description of the Related Art

Conventionally, as the image display apparatus, an apparatus using an electron emitting element has been well known.

For example, a structure using sprint type electron emitting element having a cone shaped electrode and a gate electrode in the vicinity thereof, a structure using a surface conduction type emitting element as an electron emitting element, a structure using carbon nano tube as an electron emitting element and the like have been well known.

As an example of the image display apparatus using the electron emitting element, an apparatus disclosed in Japanese Patent Application Laid-Open No. 11-250840, and Japanese Patent Application Laid-Open No. 11-250839 can be mentioned.

Meanwhile, a plasma display has been known as well as an image display apparatus which uses an electron emitting element and a light emitter disposed with a space from the electron emitting element, making the light emitter emit light by irradiating the light emitter with electrons emitted from the electron emitting element. The configuration of the plasma display is disclosed in, for example, Japanese Patent Application Laid-Open No. 11-24629.

Further, Japanese Patent Application Laid-Open No. 2003-29697 has disclosed that the trajectory of an electron emitted from a cold cathode element due to charging of its spacer is curved in a direction approaching the spacer, that distortion of an image may occur due to collision of the electron with a position different from a normal position on a fluophor and that the luminance of an image in the vicinity of the spacer may drop due to collision of an electron emitted from the element with the spacer. Additionally, a configuration for reducing unevenness of luminance in terms of visual sense by correcting the light volume of a bright spot in a structure in which the interval between the bright spots is unequal has been also disclosed.

SUMMARY OF THE INVENTION

In an image display apparatus, a structure capable of achieving a more favorable image display has been demanded. The more favorable image display is an image display having as little unevenness as possible.

More specifically, the inventor of the present invention has found out that a particular problem is generated in the image display apparatus comprising an electron emitting element and a light emitter disposed with an interval to the electron emitting element for making the light emitter emit light by irradiating the light emitter with electron emission from the electron emitting element. As a result of repeating an experiment on displaying an image with an electron source in which a plurality of electron emitting elements are disposed and fluophors each having different light emission color opposing each other, the inventor has found out that color reproducibility is different from a desired state. If picking up a specific example, it has been found out that when fluophors each having light emission colors of blue, red and green are used and it is intended to obtain blue light emission by electron irradiating to only the blue fluophor, light emission state mixed with other color slightly, that is, light emission of green and red, namely, light emission state having a poor color saturation is generated.

An object of the present invention is to achieve a favorable image display.

An object of at least a part of an invention according to the present application is to provide an image display apparatus comprising: a plurality of pixels each having an electron emitting element and a light emitting area to be irradiated by electrons from the electron emitting element; and a driving circuit for outputting a driving signal that drives the electron emitting element, wherein the plurality of the light emitting areas include a plurality of light emitting areas that respectively emit light emitting colors which differ each other, wherein the driving circuit includes a correction circuit for correcting an input signal, and wherein the correction circuit executes a correction to the input signal for a predetermined electron emitting element based on a value obtained by adjusting a value corresponding to a quantity of electrons emitted from an electron emitting element proximate to the predetermined electron emitting element by a value corresponding to the light emitting color of the light emitting area of the pixel to which the proximate electron emitting element belongs.

The contribution of electrons emitted by the proximate electron emitting element to the quantity of light emission of the pixel which the predetermined electron emitting element belongs to increases the quantity of light emission of the pixel which the predetermined electron emitting element belongs to and the correction for decreasing the input signal for compensating for this increase can be preferably adopted. In this case, if there exists a shielding member for preventing electrons caused by emission of electrons from the proximate electron emitting element from impinging on a light emitting area corresponding to a predetermined electron emitting element like a spacer described later, an increase in the quantity of light emission of a pixel which a predetermined electron emitting element belongs to by electrons emitted by the proximate electron emitting element is suppressed by a case where there is no shielding member by effect of suppressing impingement by the shielding member. Thus, the correction for decreasing the input signal in order to compensate for the increase in the quantity of light emission caused by emission of electrons from the proximate electron emitting element not receiving the effect of the suppression as the aforementioned increase can be preferably adopted. Further it is permissible to make correction in order to compensate for an increase reflecting an increase in the quantity of light emission of the pixel which the predetermined electron emitting element belongs to with electron impinging upon a light emitting area corresponding to the electron emitting element from the shielding member as reflected electron by the shielding member or secondary electron caused by electron impinging on the shielding member.

It is preferable to adopt such a structure in which the correction to the input signal for the predetermined electron emitting element is carried out based on a value obtained by adjusting a value corresponding to a quantity of electrons emitted by each of a plurality of proximate electron emitting elements proximate to the predetermined electron emitting element with a value corresponding to light emitting color of the light emission area possessed by the pixel to which each of the plurality of proximate electron emitting elements belongs.

More specifically, a structure for making correction so as to compensate for contribution of electrons emitted by the proximate electron emitting element to a quantity of light emission of a pixel which a predetermined electron emitting element belongs to can be preferably adopted.

As a value corresponding to the quantity of electrons emitted by the proximate electron emitting element, an input signal for driving the proximate electron emitting element can be used. The input signal can be subjected to the correction carried out in this embodiment. Therefore, the predetermined input signal and a signal for actually driving the proximate electron emitting element each can adopt a different value.

If adjustment for a value corresponding to the quantity of electrons emitted from each of plural proximate electron emitting elements corresponding to a same light emission color may be an equal adjustment (multiplying with an equal adjustment coefficient), it is permissible to use a value as a result of making the equal adjustment on a sum of values corresponding to the quantities of electrons emitted by each of the plural proximate electron emitting elements. By making this adjustment for each color, it is permissible to adopt a structure using a sum of these results as a correction value.

It is permissible to preferably adopt such a structure in which an image display apparatus further comprises a shielding member which suppresses impinging on a light emission area other than the light emission area corresponding to the electron emitting element by electrons caused by emission of electrons from the electron emitting element, wherein the correction to the input signal for the predetermined electron emitting element proximate to the shielding member is carried out based on a value obtained by adjusting a value corresponding to the quantity of electrons emitted by the proximate electron emitting element in which electrons caused by emission of electrons from the proximate electron emitting element is prevented from impinging upon the light emitting area corresponding to the predetermined electron emitting element by the shielding member, with a value corresponding to each light emitting color of the light emission area possessed by the pixel to which the proximate electron emitting element belongs.

In this structure, it is permissible to preferably adopt a correction for increasing the value of input signal in order to compensate for such an amount that the increase of the quantity of light emission of a light emitting area corresponding to a predetermined electron emitting element is suppressed by an existence of the shielding member.

It is permissible to preferably adopt such a structure in which the correction to the input signal for the predetermined electron emitting element is carried out based on a value obtained by adjusting a value corresponding to the quantity of electrons emitted by each of a plurality of electron emitting elements proximate to the predetermined electron emitting element and in which the electrons caused by emission of electrons from the proximate electron emitting element is prevented from impinging upon the light emitting area corresponding to the predetermined electron emitting element, with the value corresponding to each light emitting color of the light emission area possessed by a pixel to which each of the proximate electron emitting elements belongs.

Particularly, it is permissible to preferably adopt such a structure in which the correction to the input signal for a predetermined electron emitting element proximate to the shielding member includes a correction executed based on a value obtained by adjusting a value corresponding to a quantity of electrons emitted by a specific proximate electron emitting element with a value corresponding to the light emitting color of the light emitting area possessed by the pixel to which the proximate electron emitting element belongs, and the specific proximate electron emitting element (i) is an electron emitting element proximate to the predetermined electron emitting element, (ii) electron caused by emission of electron from the specific proximate electron emitting element is not prevented from impinging upon a light emitting area corresponding to the predetermined electron emitting element by the shielding member, and (iii) electrons caused by impinging of electrons emitted from the specific proximate electron emitting element onto the shielding member (secondary electron and the like outputted from the shielding member by impinging electron onto the reflecting electron in the shielding member or the shielding member) impinges upon a light emitting area corresponding to the predetermined electron emitting element. Further, it is permissible to preferably adopt such a structure in which the correction based on a value obtained by adjusting a value corresponding to the quantity of electrons emitted by the predetermined proximate electron emitting element with a value corresponding to light emitting color from a light emitting area possessed by the pixel to which the proximate electron emitting element belongs is a correction in which the quantity of light emission obtained by an input signal corrected based on the adjusted value is smaller than in case where the correction is not carried out.

The present invention includes a television apparatus and more specifically, the invention has disclosed a television apparatus comprising: a receiving circuit for receiving a television signal; and the image display apparatus for executing a display based on a signal received by the receiving circuit.

In the meantime, as a light emitter having a light emitting area, a fluophor may be used. The increase of the quantity of light emission from a light emitting area corresponding to a predetermined electron emitting element, caused by electron emitted by the electron emitting element proximate to the predetermined electron emitting element is an increase of the quantity of light emission caused by electron emitted by the proximate electron emitting element, which is reflected and impinges upon a light emitting area corresponding to the predetermined electron emitting element or an increase of the quantity of light emission caused by secondary electron generated by electron emitted by the proximate electron emitting element, which impinges upon a light emitting area corresponding to the predetermined electron emitting element.

DESCRIPTION OF THE DRAWINGS

FIGS. 7A to 7F are a diagram showing the values of coefficients a11 to a77;

FIGS. 8A to 8G are a diagram showing the values of coefficients a11 to a77.

DETAILED DESCRIPTION OF THE INVENTION

As a result of accumulated researches, the inventor of the present invention has recognized that drop in color saturation seen in a conventional image display apparatus using an electron emitting element is generated when an electron emitted by the electron emitting element enters into not only a light emitting area corresponding to the electron emitting element but also a light emitting area of different colors in the vicinity of (including adjacent to) that area, and as a result of making efforts, the inventor found out the structure of a novel image display apparatus and correction method of its drive signal to improve that problem.

Hereinafter, a specific example of the image display apparatus and correction method of its drive, signal of the present invention will be described.

Although to simplify a description of following embodiments, the description will be made premising such an image display apparatus in which image data to be inputted to the image display apparatus and display luminance are linear, it is evident that the application scope of the present invention is not restricted to this example.

Hereinafter, in a structure in which a predetermined light emitting area and a light emitting area proximate to that predetermined light emitting area exist, light emission from the light emitting area proximate to the predetermined light emitting area accompanied by electron emission to the predetermined light emitting area from an electron emitting element corresponding to the predetermined light emitting area is referred to as halation.

First Embodiment

As a first embodiment of the present invention, a filter for use in softening reduction of image quality due to halation and relating filter processing will be described.

In an image display apparatus of this embodiment, its screen is constituted of a plurality of pixels. Each pixel has a light emitting area having any one of plural different colors, particularly, red (R), green (G) and blue (B) as its light emitting color. As a light emitter constituting the light emitting area, a fluophor which emits light as a result of irradiation of electrons is used. Representation of a neutral color in terms of visual sense is realized by adjusting the quantity of light emission of each color by combining a pixel having a red light emitting area, a pixel having a green light emitting area, and a pixel having a blue light emitting area. Each pixel has an electron emitting element for irradiating a light emitting area possessed by each pixel with electrons. Particularly, as a preferable electron emitting element, a surface conduction type emitting element is used here.

Figure 10:
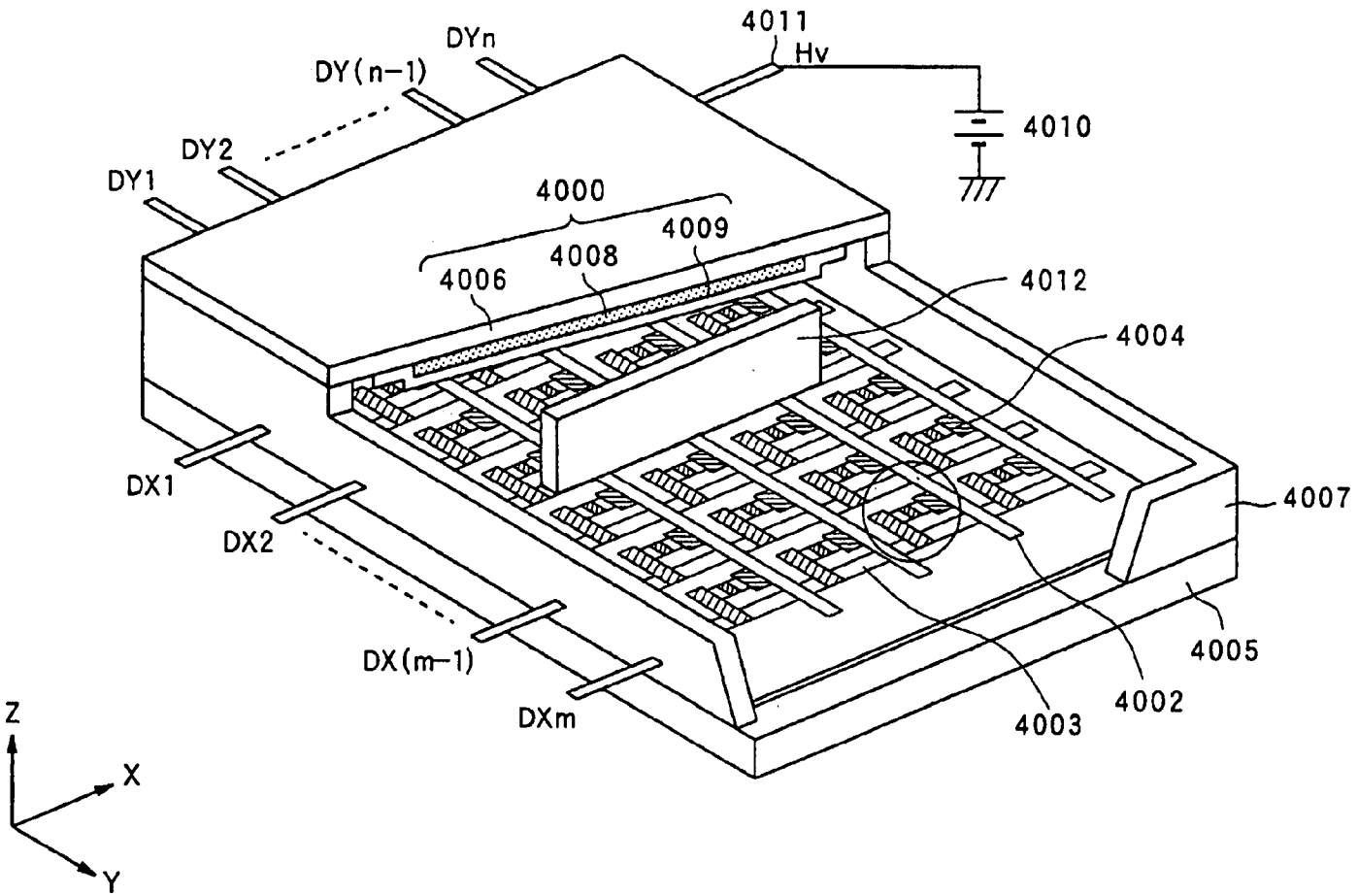
FIG. 10 is a diagram showing the structure of a display portion used in the embodiment.

FIG. 10 is a diagram showing the structure of a display portion of an image display apparatus of an embodiment described below.

Figure 11:
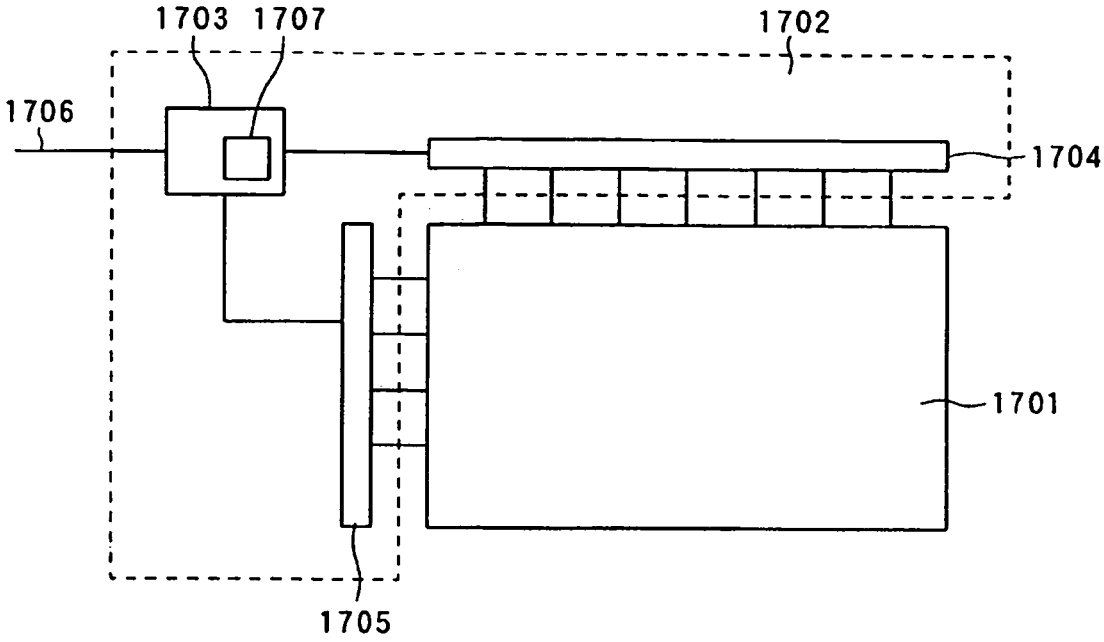
FIG. 11 is a diagram showing an embodiment of the image display apparatus.

FIG. 11 is a diagram showing the structure of the image display apparatus of the embodiment described below. This image display apparatus comprises a display portion 1701 and a drive circuit 1702. FIG. 10 shows the structure of the display portion 1701. The drive circuit 1702 comprises a modulation signal output circuit 1704, a scanning signal output circuit 1705 and a signal processing circuit 1703. The modulation signal output circuit 1704 supplies a modulation signal to the display portion 1701. The scanning signal output circuit 1705 supplies a scanning signal to the display portion 1701. The signal processing circuit 1703 processes an external signal (signal from computer or the like) inputted through an input line 1706 or a broadcasting signal received by an antenna possessed by the signal processing circuit 1703 so as to generate a tone signal or a timing signal and supplies these to the modulation signal output circuit 1704 or the scanning signal output circuit 1705. The signal processing circuit 1703 has a correction circuit 1707 and the correction circuit 1707 executes correction processing, which will be described below.

The display portion shown in FIG. 10 comprises an electron emitting element and a light emitter. As the electron emitting element, a variety of electron emitting elements, for example, a spint type electron emitting element constituted of an emitter cone and a gate electrode in combination, an electron emitting element using carbon fiber such as carbon nano tube or graphite nano fiber, MTM type electron emitting element are used. In the embodiment shown here, surface conduction type emitting elements 4004 are used as a specifically preferable electron emitting element. Here, a structure in which a plurality of surface conduction type emitting elements 4004 are connected in a matrix with a plurality of scanning signal applying wires 4002 and a plurality of modulation signal applying wires 4003 is adopted. Scanning signals outputted by the scanning signal output circuit 1705 are applied to a plurality of the scanning signal applying wires 4002 successively. Further, a modulation signal outputted by the modulation signal output circuit 1704 is applied to a plurality of the modulation signal applying wires 4003. The electron emitting element, and the scanning signal applying wires and the modulation signal applying wires connected thereto in a matrix, are provided on a glass plate 4005 as a substrate.

According to the embodiment shown here, a fluophor 4008 is used as a light emitter. The fluophor 4008 is provided on the glass plate 4006 acting as a substrate. A metal back 4009, which is an acceleration electrode for accelerating electrons emitted by the electron emitting element is provided on the glass plate 4006. An acceleration potential is supplied from a power supply 4010 to the metal back 4009 through a high-voltage terminal 4011. A glass frame 4007 serving as an external frame is positioned between the glass plate 4005 and the glass plate 4006. A gap between the glass plate 4005 and the glass frame 4007 and a gap between the glass plate 4006 and the glass frame 4007 are sealed in air-tight condition and an air-tight container is constituted of the glass plate 4005, the glass plate 4006 and the glass frame 4007. The interior of the air-tight container is kept in vacuum. A spacer 4012 is disposed in this air-tight container so as to prevent the air-tight container from being crushed by a difference in pressure between inside and outside of the air-tight container.

In the display portion having this structure, a position substantially opposing each electron emitting element serves as a light emitting area corresponding to each electron emitting element.

Figure 1:
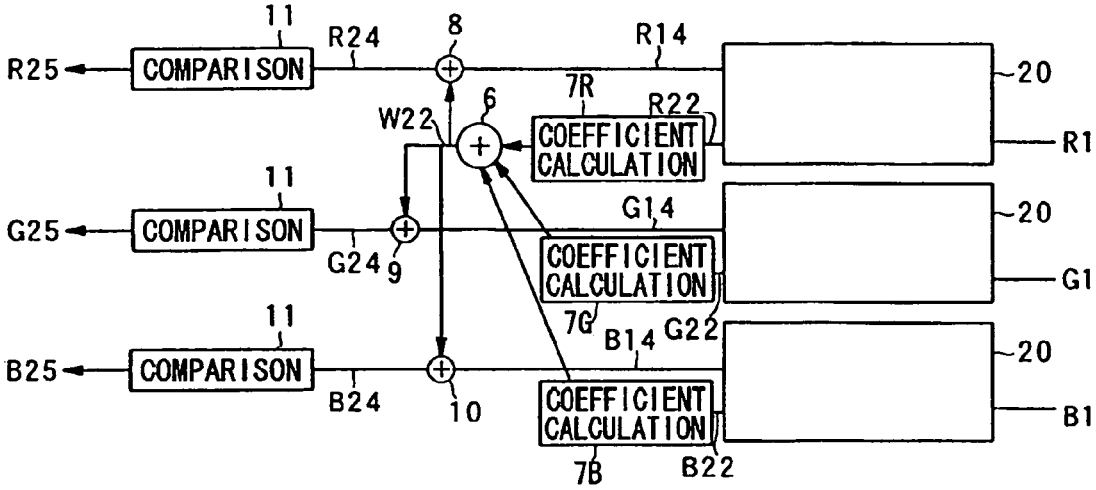
FIG. 1 is a circuit block diagram according to a first to third embodiment.

FIG. 1 is a circuit diagram showing the structure of a correction circuit according to this embodiment. Referring to the same Figure, reference numeral 20 denotes a proximity data integrating portion (integrating circuit), reference numeral 6 denotes an RGB adding portion (adding circuit; correction value calculation circuit), and reference numerals 7R, 7G, 7B denote coefficient computing portions for computing with adjustment coefficient corresponding to red, green and blue. Reference numerals 8, 9, 10 denote an adder (drive signal generating circuit), and reference numeral 11 denotes a comparator. The proximity data integrating portion 20 includes three circuits having a same configuration for RGB.

Sampled digital RGB data R1, G1, B1 are inputted to the proximity data integrating portion 20 as input signal. This RGB is data linear to luminance. If the RGB data is nonlinear to luminance, it can be converted to linear data with a table or the like.

Figure 2:
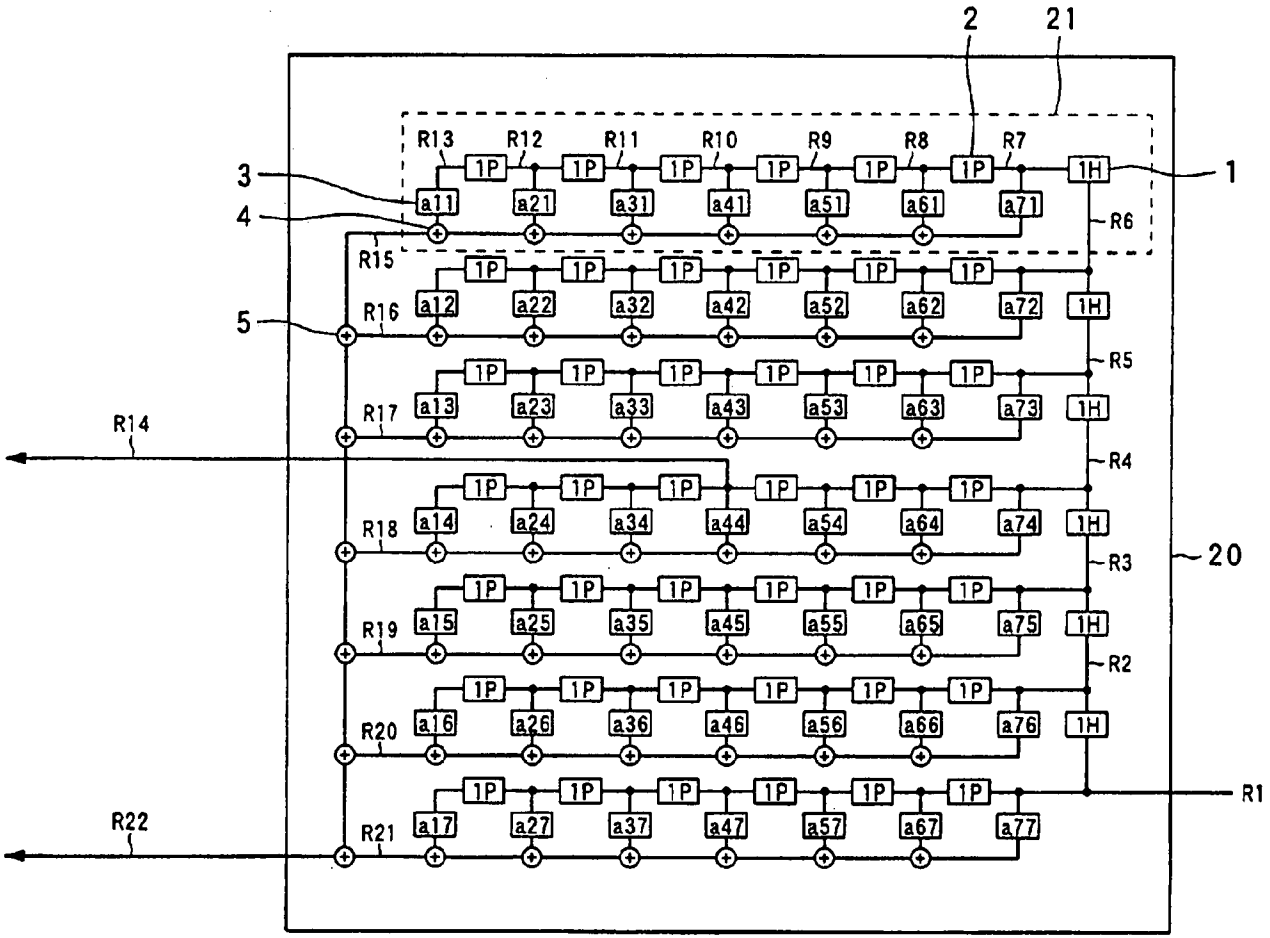
FIG. 2 is a detailed diagram of an adder; integrating portion.

FIG. 2 is a detailed diagram of the proximity data integrating portion 20 of FIG. 1. In the same Figure, reference numeral 1 denotes a horizontal synchronous period (1H) delay circuit, reference numeral 2 denotes a pixel (1P) delay circuit, reference numeral 3 denotes a multiplier picking up coefficients as data, reference numeral 4 denotes a horizontal adder which integrates data in a horizontal direction, and reference numeral 5 denotes a vertical adder which integrates the data integrated in the horizontal direction in a vertical direction.

Processing of the proximity data integrating portion 20 will be explained using FIG. 2. Sampled digital RGB signals R1, G1, B1 are inputted to the proximity data integrating portion 20. The proximity data integrating portion 20 will be described by taking R as an example because it has the same structure regardless of RGB.

First, the 1H delay circuit 1 will be explained. Data R1 inputted to the proximity data integrating portion 20 is delayed by 1H by the 1H delay circuit 1. A signal as a result of delaying R1 by 1H is called R2, a signal as a result of delaying further by 1H is called R3, a signal as a result of delaying further by 1H is called R4, a signal as a result of delaying further by 1H is called R5, a signal as a result of delaying further by 1H is called R6 and a signal as a result of delaying further by 1H is called R7.

Because usually image data is inputted from row data on the screen, the signal R2 is always data on a row of R1. Likewise, R3 is data on a row of R2, R4 is data on a row of R3, R5 is data on a row of R4, R6 is data on a row of R5, and R7 is data on a row of R6.

Next, the 1P delay circuit 2 will be described. The 1P delay circuit 2 is a circuit which delays data by a pixel in the horizontal direction. For example, the signal R8 is a signal as a result of delaying the signal R7 by a pixel. Because usually, image data is inputted from data on the left of the screen, always the signal R8 is pixel data on the left of the signal R7. Likewise, R9 is pixel data on the left of R8, R10 is pixel data on the left of R9, R11 is pixel data on the left of R10, R12 is pixel data on the left of R11, and R13 is pixel data on the left of R12. Although the 1P delay circuit has been explained on the topmost row 21 of the proximity data integrating portion 20, the 1P delay circuit 2 carries out the same processing on any row of the proximity data integrating portion 20.

Data in the center in the up/down and right/left directions (hereinafter referred to as noteworthy pixel) of the proximity data integrating portion 20 (hereinafter referred to as noteworthy pixel data) is regarded as R14. The noteworthy pixel data R14 is data as a result of delaying R4 data by three pixels in the horizontal direction. That is, the noteworthy pixel data R14 is data displayed on a pixel moved by three pixels to the left from the displayed pixel of the data R4. Likewise, the noteworthy pixel data R14 is data displayed on a pixel moved by three pixels down from the displayed pixel of the data R10.

If paying attention to the noteworthy pixel data R14, data within the proximity data integrating portion 20 is data within a rectangle composed of seven pixels each vertically and horizontally around a noteworthy pixel. For example, R10 is data up by three pixels to R14, R4 is data to the right by three pixels of R14, and R7 is data up by three pixels and to the right by three pixels to R14. That is, the proximity data integrating portion 20 can process data of seven pixels each vertically and horizontally around the noteworthy pixel data. Generally, this is called a 7-tap filter.

The quantity of the aforementioned filter taps (in this embodiment, 7) is determined by a range which halation reaches. According to this embodiment, if an electron is irradiated on a fluophor, circular light emission occurs by halation around that pixel. If the diameter of the circular area halation which should be considered reaches is n pixels, a n-tap filter is necessary.

Although according to this embodiment, n=7 is set up, if the range the halation which should be considered is only pixels adjacent to the noteworthy pixel up/down and to the right/left, a filter of n=3 can be used.

The diameter of the area which the aforementioned halation reaches depends on an interval between a face plate (glass plate 4006) in which the fluophor is disposed and a rear plate (glass plate 4005) in which an electron source is disposed. Therefore, the quantity of filter taps can be determined corresponding to the interval between the face plate and the rear plate.

Figure 3:
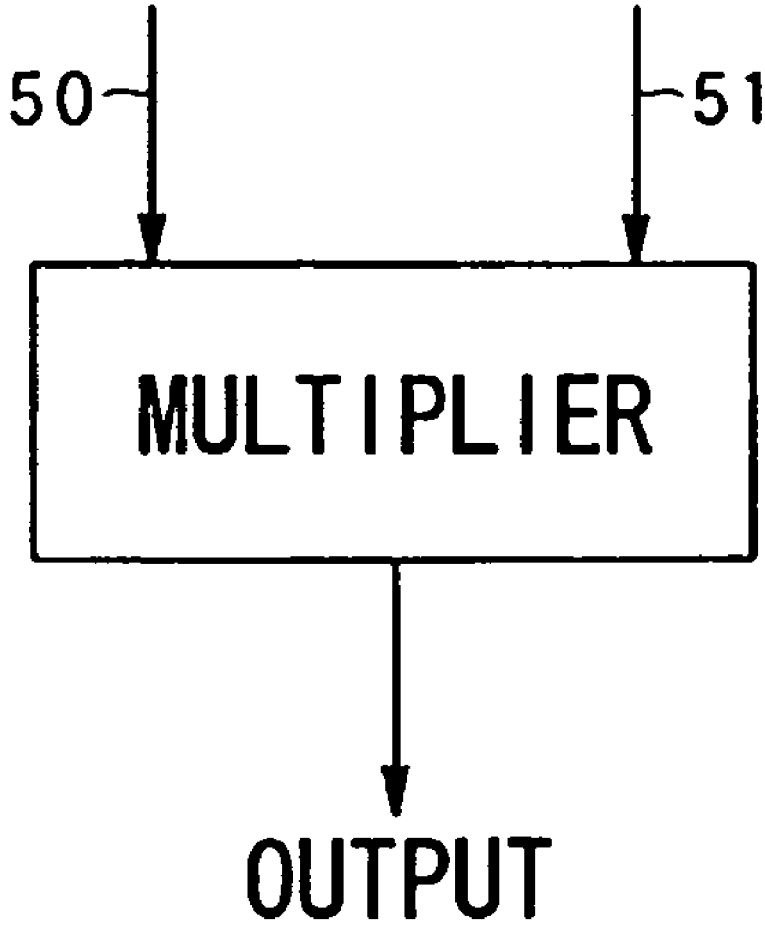
FIG. 3 is a detailed diagram of an adder.

Next, the multiplier 3 will be described. FIG. 3 is a diagram showing the structure of the multiplier 3. The multiplier 3 outputs a result of multiplying two inputs 50, 51. According to this embodiment, reference numeral 50 denotes data and reference numeral 51 denotes a coefficient to be multiplied. For example, if the data 50 is R13 in FIG. 2, the coefficient 51 is a1. Although originally, the multiplier has the structure shown in FIG. 3, FIG. 2 indicates a coefficient within the multiplier 3 in a simplified fashion.

As shown in FIG. 2, data R12 is multiplied with a coefficient a21, data R11 is multiplied with a coefficient a31, data R10 is multiplied with a coefficient a41, data R9 is multiplied with a coefficient a51, data R8 is multiplied with a coefficient a61, and data R7 is multiplied with a coefficient a71. Although processing of the multiplier 3 has been explained on the topmost row 21 of the proximity data integrating portion 20, the multiplier 3 carries out the same processing on any row within the proximity data integrating portion.

The horizontal adder 4 adds data of a single row. According to this embodiment, six horizontal adders 4 exist for each row. Because the horizontal adders 4 are provided for seven rows, in total 6×7=42 horizontal adders 4 are necessary within the proximity data integrating portion 20. Data to be inputted to the horizontal adder 4 is an output from the multiplier 3. The horizontal adder 4 adds data outputted from the multiplier 3 by a single row.

By taking the topmost row 21 of the proximity data integrating portion 20 as an example, processing of the multiplier 3 and the horizontal adder 4 can be expressed as follows.

$$R15=R13\times a11+R12\times a21+R11\times a31+R10\times a41+R9\times a51+R8\times a61+R7\times a71 \quad \text{(Equation 1)}$$

The above equation indicates a processing of the topmost row 21 of the proximity data integrating portion 20 and the same processing is carried out on any row in the proximity data integrating portion 20. The detail of the coefficients a11 to a77 will be described below.

Proximity data integrated in the horizontal direction in this way is added in the vertical direction by the vertical adder 5. Assuming that the proximity data of each row outputted by the horizontal adder 4 is R15 to R21 as shown in FIG. 2, an output value R22 of the vertical adder 5 is expressed in a following equation.

$$R22=R15+R16+R17+R18+R19+R20+R21 \quad \text{(Equation 2)}$$

According to this embodiment, R22 is called the proximity data integrated value. The proximity data integrated value R22 is a value as a result of integration with proximity data of the noteworthy pixel R14 applied with a weight of the coefficients a11 to a77. In this way, the proximity data integrating portion 20 outputs two signals of the noteworthy pixel data R14 and proximity data integrated value R22.

The above description is about the processing of the proximity data integrating portion 20. Although only a processing example about R has been explained above, completely the same processing is executed for G and B. About G, G1 is inputted and consequently, noteworthy pixel data G14 and proximity data integrated value G22 are outputted. About B, B1 is inputted and noteworthy pixel data B14 and proximity data integrated value B22 are outputted.

Next, a processing after the proximity data integrating portion 20 will be described with reference to FIG. 1. Proximity data integrated values R22, G22, B22 outputted from the proximity data integrating portion 20 are multiplied with an adjustment coefficient ($k_R$, $k_G$, $k_B$) of each color by coefficient computing portions 7R, 7G, 7B.

In the meantime, the coefficient computing portions 7R, 7G, 7B multiply each of inputted data R22, G22 and B22 with a predetermined coefficient. This coefficient aims at reflecting the degree of influence of halation on a correction value and is determined as follows.

The intensity of light emission (light emission not including halation, hereinafter referred to as bright spot) by irradiation of electron from an electron source is assumed to be L0, and the intensity of light emission caused by halation is assumed to be L1. A coefficient k to be multiplied by the coefficient computing portion 7 (7R, 7G, 7B) is determined according to a following equation.

$$k=L1/L0 \quad \text{(Equation 3)}$$

Here, the value of k can be obtained by experiment. Because usually L0 is larger than L1, k is a value between 0 and 1. Particularly in this embodiment, by paying attention to that this coefficient k varies depending on each color, the coefficient k is obtained for each corresponding color and used as adjustment coefficients $k_R$, $k_G$, $k_B$.

More specifically, here it is set up that $k_R$=0.015, $k_G$=0.012 and $k_B$=0.018.

This means that 1.5%, 1.8% and 1.2% of a value of input signal (pixel data), which is a value substantially corresponding to the quantity of electrons emitted by the proximate electron emitting element which is an object for halation correction is an increment of the quantity of light emission of the noteworthy pixel.

In the coefficient computing portion of this embodiment, after each coefficient is multiplied with an input signal, the value of k is outputted with its sign inverted. An output of each coefficient computing portion 7R, 7G, 7B is added by the RGB adding portion 6. Assuming that an output of the RGB adding portion 6 is W22, W22 is expressed in a following equation.

$$W22=-(k_R R22+k_G G22+k_B B22) \quad \text{(Equation 4)}$$

This W22 is a correction value to be added to the noteworthy pixel data R14, G14, B14. The outputs R24, G24, B24 of the adders 8, 9, 10 are expressed in a following equation.

$$R24=R14+W22 \quad \text{(Equation 5)}$$

$$G24=G14+W22 \quad \text{(Equation 6)}$$

$$B24=B14+W22 \quad \text{(Equation 7)}$$

The comparator 11 compares inputted data with 0 and outputs a larger value. Thus, output data R25, G25, B25 of the comparator 11 are as follows.

$$R25 = R24:R24 > 0 \quad \text{(Equation 8)}$$
$$= 0:R24 \le 0$$

$$G25 = G24:G24 > 0 \quad \text{(Equation 9)}$$
$$= 0:G24 \le 0$$

$$B25 = B24:B24 > 0 \quad \text{(Equation 10)}$$
$$= 0:B24 \le 0$$

Next, coefficients a11 to a77 of the proximity data integrating portion 20 will be described.

Figure 4A:
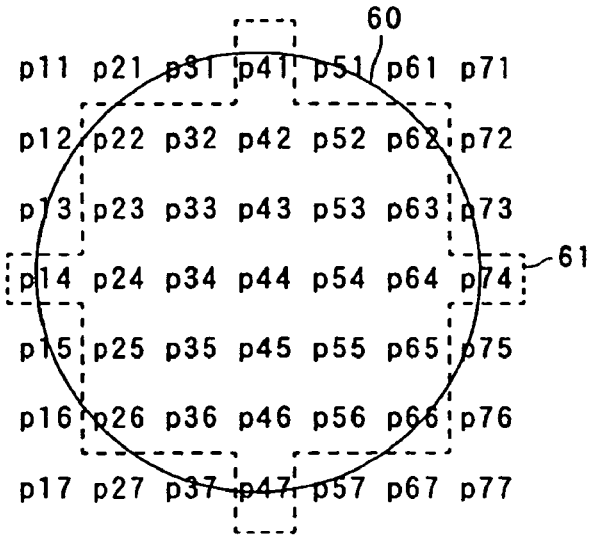
FIG. 4A is an arrangement diagram of pixels around a noteworthy pixel and FIG. 4B is a diagram showing values of coefficients a11 to a77.

FIG. 4A shows a disposition of seven pixels each in a vertical and horizontal direction corresponding to a same color around the noteworthy pixel p44 with a pixel p44 corresponding to a color as a noteworthy pixel. pnm (n, m indicate 1 to 7) indicates a pixel. Assume that at some timing, the coefficients applied to data of the pixels p11 to p77 are a11 to a77.

The image display apparatus of this embodiment has a structure in which halation emission is generated in a circular area around a bright spot. A solid line 60 in FIG. 4A indicates an area in which halation emission is generated when the noteworthy pixel p44 is lit. According to this embodiment, the circle of a solid line 60 is approximated by a dotted line 61 to simplify the coefficients a11 to a77. That is, if halation emission occurs in pixels surrounded by the dotted line 61 when the noteworthy pixel p44 is lit, the circle of the solid line is approximated.

Pixels in which halation emission occurs when the noteworthy pixel p44 is lit are pixels surrounded by the dotted line 61 and this means that when pixels surrounded by the dotted line 61 are lit, the noteworthy pixel p44 undergoes halation emission by a reflected electron.

Figure 4B:
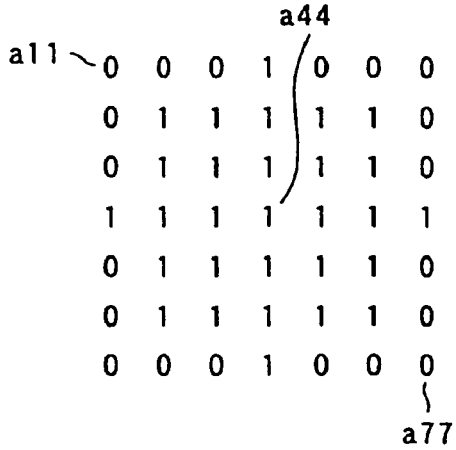

According to this embodiment, it is assumed that the coefficients a11 to a77 are 0 or 1. The coefficient of the pixel capable of causing halation emission in the noteworthy pixel is 1 and the coefficient of other case is 0. Because the pixels which can cause halation emission in the noteworthy pixel are pixels within the dotted line 61 in FIG. 4A, the coefficients a1 to a77 are as shown in FIG. 4B. In this Figure, the left top indicates coefficient a11, the right bottom indicates a coefficient a77 and the center indicates a coefficient a44 of the noteworthy pixel.

According to this embodiment, the pixels which can cause halation emission in the noteworthy pixel are assumed to be of a 7×7 pixel area. For example, in case of 3×3 pixel area, the coefficients of pixels up/down and to the right/left of a noteworthy pixel, that is, a43, a34, a44, a54, a45 are 1 and the coefficients of other ones are 0. If there is no case where reflected electron of the noteworthy pixel is irradiated on the noteworthy pixel, a44 only needs to be 0.

If the coefficients a11 to a77 are set as described above, the proximity data integrating values R22, G22, B22 of FIG. 1 are integration values of each color of data of pixels which cause halation emission in the noteworthy pixel. Because halation is emission of light by reflected electron, it is generated regardless of R, G, B in an image display apparatus using the electron emitting element. That is, the reflected light. Naturally, the reflected electrons of G, B make light. Naturally, the reflected electrons of G, B make the noteworthy pixels of other colors emit light. Thus, it is so constructed that halation data of other colors can be subtracted from the noteworthy pixel data in order to suppress reduction of color saturation.

The coefficient computing portions 7R, 7G, 7B are a circuit which multiplies an integration value of each color of data of a pixel which causes halation emission in the noteworthy pixel with a coefficient for evaluation of an increment of the quantity of light emission generated by the halation for each color. Computing is carried out in each color, therefore this can meet a structure in which reflectance to irradiated electron varies depending on fluophor corresponding to each color.

The RGB adding portion 6 integrates outputs of the coefficient computing portions 7R, 7G, 7B of each of the RGB. By multiplying a pixel data integration value corresponding to plural proximate electron emitting elements of each color which cause halation emission in the noteworthy pixel with a coefficient for evaluating an increment by halation emission of each color, a sum W22 is obtained and then a negative sign is added to this value.

Data R24, G24, B24 as a result of subtracting the data W22 from the noteworthy pixel data R14, G14, B14 are data excluding the quantity of light emission by halation (an increment in quantity of light emission at the noteworthy pixel by halation).

At this time, if W22 is larger than R14, R24 turns to a negative value. In this case, the comparator 11 outputs as 0. Data R25, G25, B25 obtained in this way are image data as a result of subtracting the quantity of light emission by halation. If the electron emitting element constituting the image display apparatus is driven based on this data, the quantity of light emission by halation subtracted on the image data is added by actual halation so that light is emitted at a desired luminance and with a desired chromaticity. That is, by using a value considering the proximity data value of other color as display data of a predetermined color, a display with a preferred chromaticity can be achieved.

Figure 5A:
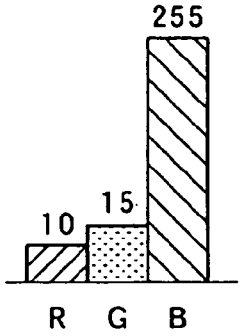
FIGS. 5A to 5C are a diagram for explaining correction of the first embodiment.

FIG. 5 shows an example of the RGB data value when attention is paid on some pixel. Assume that original data is R=10, G=15, B=255 as shown in FIG. 5A. This is data which looks like blue in an image display apparatus free of halation.

Figure 5B:
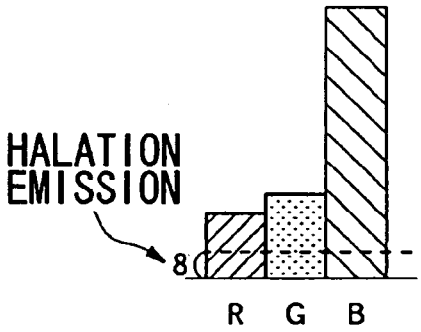

If an image is displayed without the correction mentioned in this embodiment, the display of the image is carried out such that halation from surrounding pixels is added as shown in FIG. 5B.

Figure 5C:
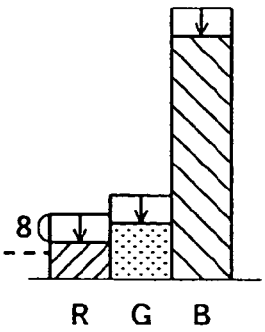

In the correction of this embodiment, the quantity of light emission by the halation is subtracted from the image data as shown in FIG. 5C. If speaking about the above example, because the quantity of light emission by halation corresponds to 8 of the image data, this quantity is subtracted from the image data and the electron emitting element is driven with date of R=2, G=7, B=247 to display an image. As a result, the quantity of halation emission is added by the actual halation when an image is displayed and the color saturation lowered by the halation is corrected to the same color saturation as original data, so that an image is displayed at the same RGB luminance, color saturation and chromaticity as the original data.

This embodiment has been described about a display apparatus in which image data inputted to the image display apparatus is linear to display luminance in order to simplify the description. In an display apparatus in which the image data and the display luminance are non-linear, the image data needs to be converted to data meeting the display characteristic using a table or the like when displaying the image.

Although according to this embodiment, not only halation within a single pixel but also halation in a 7×7 pixel area has been considered, considering of an influence by electron from which electron emitting element other than an electron emitting element corresponding to the light emitting area onto light emission of the noteworthy light emitting area can be determined appropriately and by setting a11 to a77 for use in the proximity data integrating portion correspondingly, an object for which halation needs to be considered can be selected.

Second Embodiment

The display portion shown in FIG. 10 has a spacer 4012. This spacer 4012 prevents the air-tight container from being crushed by a difference of pressure between inside and outside of the air-tight container. This spacer 4012 shields electron originating from an electron emitted from a predetermined electron emitting element (of part of electrons emitted from that electron emitting element, electron going toward a light emitting area which other electron emitting element meets and electron which after reflected by a light emitter (fluophor) or other member nearby (base plate on which the fluophor is disposed or metal back which is an accelerating electrode), goes toward a light emitting area which other electron emitting element meets) in order to prevent that electron from being irradiated to a light emitting area corresponding to other electron emitting element. The glass substrate 4005 or a rib provided on the glass substrate 4006 can turn to an electron shielding member which generates the operation of electron shielding. If such an electron shielding member is disposed in a uniform positional relation corresponding to a11 electron emitting elements, the operation of electron shielding occurs to each electron emitting element. However, if the electron shielding members are disposed unequally within the display portion like the spacer 4012 shown in FIG. 10, the operation of electron shielding corresponding to each electron emitting element by the electron shielding member becomes unequal. For example, electrons originating from electron emitted by an electron emitting element nearby the spacer 4012 are shielded by the spacer 4012 so that it does not reach a light emitting area corresponding to an electron emitting element located on an opposite side to the former electron emitting element with respect to the spacer 4012. The operation of electron shielding by this spacer 4012 is not generated at an electron emitting element located sufficiently far from the spacer 4012. Therefore, the operation of electron shielding by the spacer 4012 is generated non-uniformly.

As the second embodiment of the present invention, an example that the processing of the first embodiment is changed about only a portion near the spacer will be described. Near the spacer, halation intensity is lowered because reflected electron is shielded by the spacer (shielding member). If the same filter as the first embodiment is applied near the spacer like a portion not near the spacer, over-correction occurs near the spacer. According to this embodiment, this problem is solved about the portion near the spacer by changing the coefficients a11 to a77.

The circuit of this embodiment is equal to that shown in FIGS. 1, 2. A different point is that the value of the coefficients a11 to a77 of the proximity data integrating portion 20 change.

Figure 6:
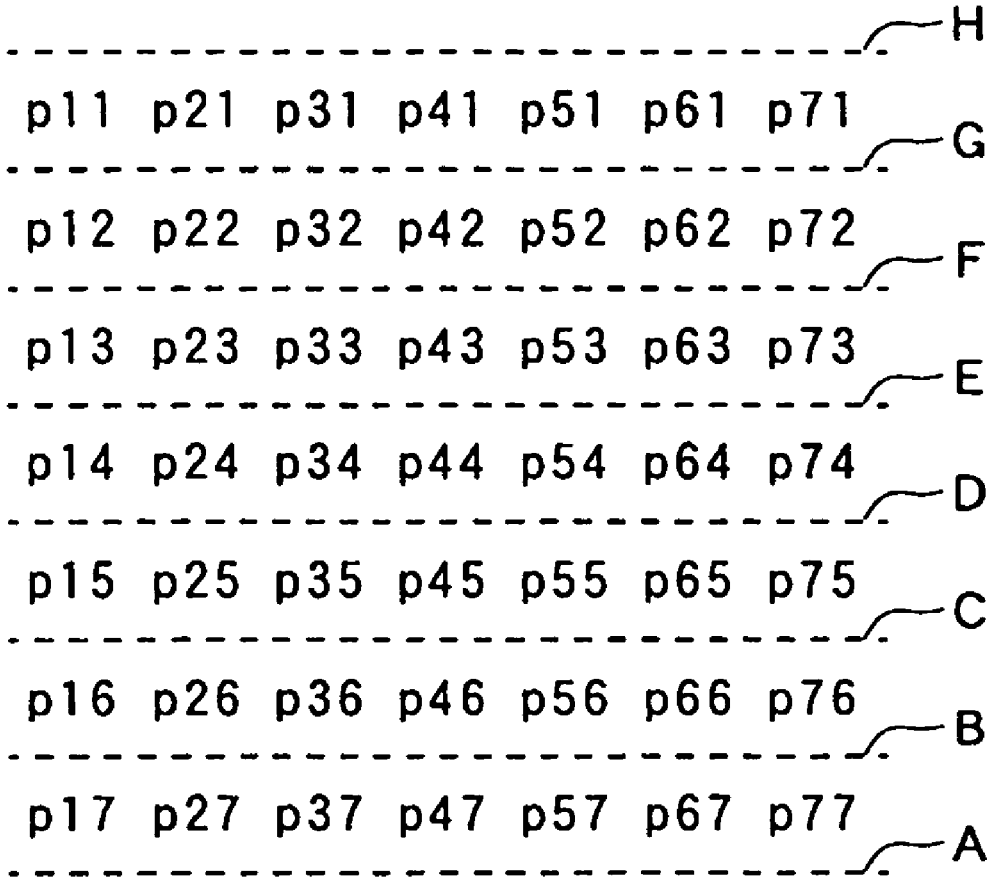
FIG. 6 is an arrangement diagram of pixels and spacers around the noteworthy pixel.

The pixels of the seven taps of the proximity data integrating portion 20 are assumed to be p11 to p77 as shown in FIG. 6. The coefficients a11 to a77 of FIG. 2 are coefficients which are to be multiplied with pixel data of the pixels p11 to p77.

According to this embodiment, it is assumed that the spacer is a plate-like member disposed in the center of a pixel row and a row under it.

A pixel row on the spacer is called upper first proximity, a pixel row thereon is called upper second proximity and a pixel row thereon is called upper third proximity. For example, if the spacer exists at a position of A in FIG. 6, the upper first proximity is a row of p17 to p77, the upper second proximity is a row of p16 to p76 and the upper third proximity is a row of p15 to p75. Further, a pixel row under the spacer is called lower first proximity, a pixel row thereunder is called lower second proximity and a pixel row thereunder is called lower third proximity. For example, if the spacer is located at the position of B in FIG. 6, a row of p17 to p77 is the lower first proximity.

According to this embodiment, it is assumed that vertical resolution of the display apparatus is 768 while 20 spacers are disposed every other 40 rows.

If the spacer exists at a position A in the same Figure of FIG. 6, an electron irradiated to the noteworthy pixel p44 when the electron emitting element of pixel proximate to the noteworthy pixel p44 emits electron (mainly an electron emitted by the electron emitting element of a pixel proximate to a noteworthy pixel, then reflected and irradiated to the noteworthy pixel and which is called reflected electron depending on a case) is never shielded by the spacer. The reason is that the lower limit of the row in which reflected electron to be irradiated on the noteworthy pixel p44 is generated is p17 to p77 and reflected electrons on lower rows are never irradiated to the noteworthy pixel p44 regardless of whether or not there is a spacer. Thus, if the spacer exists at the position A, the coefficients a11 to a77 are values indicated in FIG. 4B like the first embodiment.

If the spacer exists at a position B in FIG. 6, of reflected electrons irradiated to the noteworthy pixel p44, reflected electron of a pixel located on an opposite side to the noteworthy pixel p44 with respect to the spacer is shielded by the spacer. The reflected electrons of p17 to p37 and p57 to p77 are not irradiated on the noteworthy pixel p44 regardless of whether or not there is a spacer. However, reflected electron of p47 is shielded by the spacer.

As described in the first embodiment, the proximity data integrating portion 20 obtains an integration value of pixel data which cause halation emission in the noteworthy pixel. Thus, pixel data whose reflected electron is shielded by the spacer and which never causes halation emission needs to be excluded from integration. As a result, if the spacer exists at the position B in FIG. 6, the coefficient a47 is 0 and the coefficient a11 to a77 are as shown in FIG. 7A.

If the spacer exists at a position C in FIG. 6, reflected electron to be irradiated to the noteworthy pixel is shielded by the spacer. In this case, the reflected electrons of pixels p26 to p66, p47 located at an opposite side to the noteworthy pixel with respect to the spacer are shielded by the spacer. Reflected electrons of p16, p76, p17 to p37, p57 to p77 are never irradiated to the noteworthy pixel p44 regardless of whether or not there is a spacer. At this time, the coefficients a11 to a77 turn as shown in FIG. 7B.

Likewise, if the spacer exists at a position of D in FIG. 6, the coefficients a11 to a77 turn as shown in FIG. 7C.

Although the noteworthy pixel p44 is located above the spacer up to now, if the spacer comes to a position of E, the noteworthy pixel is below the spacer. Because in case of pixels below the noteworthy pixel p44, their reflected electrons are never shielded by the spacer, the coefficients a14 to a77 below the p44 are the same as the first embodiment. On the other hand, because reflected electrons of pixels above the noteworthy pixel p44 are shielded by the spacer, the coefficients a11 to a73 all turn to 0. If the spacer is located at a position E, the coefficients a11 to a77 turns as shown in FIG. 7D.

Same as above, if the spacer is located at a position F of FIG. 6, the coefficients a11 to a72 of pixels on an opposite side to the noteworthy pixel with respect to the spacer turns to 0 while other coefficients turn to the spacer turns to 0 while other coefficients turn if the spacer is located at a position F, the coefficients a11 to a77 turns as shown in FIG. 7E.

Likewise, if the spacer is located at a position G, the coefficients a11 to a77 turns as shown in FIG. 7F.

If the spacer is located at a position H, reflected electrons irradiated on the noteworthy pixel p44 are never shielded by the spacer neither. For the reason, the coefficient of this case turns as shown in FIG. 4B like the first embodiment.

Change-over of the above coefficient is carried out in a blank period within the horizontal synchronous period. For example, if the spacer exists at the position A in FIG. 6, the coefficients a11 to a77 are set to values in FIG. 4B. At this time, p17 to p77 are upper first proximity. Because input data R1, G1, B1 are pixel data of p77, it comes that the input data is data of the upper first proximity.

Next, if the spacer is located at the position B in FIG. 6, p17 to p77 are lower first proximity and the input data R1, G1, B1 are data of lower first proximity. At this time, the coefficients a11 to a77 are set to values in FIG. 7A. That is, in a blank period in which the input data changes from the upper first proximity data to the lower first proximity data, the coefficients a11 to a77 change from FIG. 4B to FIG. 7A.

Next, if the spacer is located at the position C in FIG. 6, p17 to p77 are lower second proximity. That is, the input data R1, G1, B1 are data of the lower second proximity. At this time, the coefficients a11 to a77 are set to values in FIG. 7B. In a blank period in which the input data changes from the lower first proximity data to the lower second proximity data, the coefficients a11 to a77 change from FIG. 7A to FIG. 7B.

Likewise, in the blank period in which the input data changes from the lower second proximity data to the lower third proximity data, the coefficients a11 to a77 change from FIG. 7B to FIG. 7C and in a blank period in which the input data changes from the lower third proximity to the lower fourth proximity, the coefficients a11 to a77 change from FIG. 7C to FIG. 7D. In a blank period in which the input data changes from the lower fourth proximity to the lower fifth proximity, the coefficients a11 to a77 change from FIG. 7D to FIG. 7E. In a blank period in which the input data changes from the lower fifth proximity to the lower sixth proximity, the coefficients a11 to a77 change from FIG. 7E to FIG. 7F. In a blank period in which the input data changes from the lower sixth proximity to the lower seventh proximity, the coefficients a11 to a77 change from FIG. 7F to FIG. 4B.

As a consequence, the proximity data integrated values R22, G22, B22 contain no data about reflected electrons shielded by the spacer, only data of reflected electrons irradiated by the noteworthy pixel p44 is contained therein. Like the first embodiment, this data is multiplied by adjustment coefficients $k_R$, $k_G$, $k_B$ by means of the coefficient computing portions 7R, 7G, 7B and summed up by the RGB adding portion 6 to obtain W22 and then, the W22 is subtracted from the noteworthy pixel data R14, G14, B14.

As a consequence, appropriate correction can be executed even in the proximity of the spacer without correcting halation shielded by the spacer.

Third Embodiment

As a third embodiment of the present invention, an example that data about a quantity corresponding to halation is given as the spacer proximate pixel data will be described. Because the reflected electrons are shielded by the spacer proximate to the spacer, halation intensity is lower than a place not near a spacer, so that unevenness in luminance and color saturation due to existence of the spacer is generated. According to this embodiment, without correction at a place not near the spacer, luminance and chromaticity proximate to the spacer are corrected to those that cause halation in the same way as at the place not near the spacer.

According to this embodiment, the spacer is a plate-like member disposed in the center of some pixel row and a row under that one like the second embodiment. Further, the vertical resolution of the display apparatus is 768 and 20 spacers are disposed every other 40 rows like the second embodiment.

The circuit of this embodiment is the same as FIGS. 1, 2. A point different from the first embodiment is that the values of the coefficients a11 to a77 of the proximity data integrating portion 20 change and when the coefficient computing portions 7R, 7G, 7B outputs, the sign is not inverted. The same structure as the first embodiment will be described with the same reference numerals and the description is not repeated here.

First, a case where the noteworthy pixel exists at the place not near the spacer will be described. Consider that the spacer exists at A or H or outside A or H with respect to the noteworthy pixel p44 in FIG. 6. In other words, this is equivalent to that the noteworthy pixel p44 does not exist in an interval between the upper third proximity and the lower third proximity. In this case, the reflected electron irradiated to the noteworthy pixel p44 is never shielded by the spacer, so that no unevenness in luminance and chromaticity occurs due to existence of the spacer.

According to this embodiment, the proximity data integrating portion 20 calculates data integration value of pixels whose reflected electrons are shielded by the spacer although if the reflected electrons are irradiated to the noteworthy pixels if there is no spacer. In the above case, the coefficients a11 to a77 are all set to 0 like FIG. 8A because such pixels are not present. The output data R22, G22, B22 of the proximity data integrating portion 20 of FIG. 1 all turn to 0 and the output W22 of the RGB adding portion 6 which adds a value as a result of multiplying these data with a coefficient for evaluating the quantity of light emission by halation also turns to 0.

According to the first and second embodiments, the coefficient computing portions 7R, 7G, 7B multiply with adjustment coefficients $k_R$, $k_G$, $k_B$ and invert the sign before outputting. However, the coefficient computing portions 7R, 7G, 7B of this embodiment multiply input signal with adjustment coefficients $k_R$, $k_G$, $k_B$ and outputs without inverting the sign. In the above example, because an output of the proximity data integrating portion 20 is 0, the outputs of the coefficient computing portions 7R, 7G, 7B are also 0.

The outputs of the adders 8, 9, 10 are as follows:

$$R24=R14+W22 \quad \text{(Equation 11)}$$

$$G24=G14+W22 \quad \text{(Equation 12)}$$

$$B24=B14+W22 \quad \text{(Equation 13)}$$

The noteworthy pixel data R14, G14, B14 are outputted as they are. The comparator 11 carries out processing of equations 8, 9, 10 and the outputs R25, G25, B25 of the comparator 11 are equal to R14, G14 and B14. As a result, data in a condition without any correction is displayed.

If the noteworthy pixel exists non-proximate to the spacer, according to this embodiment, the input data is displayed as it is without any correction.

Next, a case where the noteworthy pixel exists near the spacer will be described. If the spacer is located at the position B in FIG. 6, of reflected electrons irradiated to the noteworthy pixel p44, reflected electron of pixel located on an opposite side to the noteworthy pixel p44 with respect to the spacer is shielded by the spacer. The reflected electrons of p17 to p37 and p57 to p77 are not irradiated to the noteworthy pixel p44 regardless of whether or not there is a spacer. However, the reflected electron of p47 is shielded by the spacer.

According to this embodiment, the proximity data integrating portion 20 calculates data integrated value of pixels which generate reflected electrons to be irradiated to the noteworthy pixel unless the spacer is provided, the reflected electrons to the noteworthy pixel being shielded by the spacer. Thereof, if the spacer exists at the position B in FIG. 6, the coefficient a47 turns to 1 while the other coefficients turn to 0 and the coefficients a11 to a77 turn as shown in FIG. 8B.

If the coefficients a11 to a77 are as shown in FIG. 8B, the outputs R22, G22, B22 of the proximity data integrating portion 20 are equal to the RGB pixel data of p47. The RGB adder 6 sums up results of multiplying outputs of the R22, G22, B22 with a coefficient of each color by means of the coefficient computing portions 7R, 7G, 7B so as to obtain W22 as a correction value. The sum of the coefficient computing portions 7R, 7G, 7B corresponds to data of the quantity of reflected electrons corresponding to halation, not irradiated to the noteworthy pixel p44 because they are shielded by the spacer. The data W22 of the quantity of reflected electrons corresponding to halation which should have been irradiated to the noteworthy pixel if this data or the spacer had been not present is added to the noteworthy pixel data R14, G14, B14 by means of the adders 8, 9, 10.

According to this embodiment, because the coefficient computing portions 7R, 7G, 7B do not invert the sign, the outputs of the adders 8, 9, 10 are always positive. Thus, there is no problem whether or not the comparator 11 is present. That is, following relations are established:

$$R25=R24$$

$$G25=G24$$

$$B25=B24 \quad \text{(Equation 14)}$$

If the spacer is located at the position C of FIG. 6, the reflected electron which should have been irradiated to the noteworthy pixel is shielded by the spacer. In this case, the reflected electrons of p26 to p66, p47 located on an opposite side to the noteworthy pixel with respect to the spacer is shielded by the spacer. The reflected electrons of p16, p76, p17 to p37, p57 to p77 are never irradiated to the noteworthy pixel p44 regardless of whether or not there is a spacer. According to this embodiment, because the coefficient of a pixel whose reflected electron is shielded by the spacer is 1, the coefficients a11 to a77 turn as shown in FIG. 8C.

At this time, the output data of the adder 6 corresponds to data of the quantity of reflected electrons corresponding to halation, not irradiated to the noteworthy pixel p44 because they are shielded by the spacer. The data is added to the noteworthy pixel data R14, G14, B14 by the adders 8, 9, 10.

Likewise, if the spacer is located at the position D in FIG. 6, the coefficients a11 to a77 turns as shown in FIG. 8D. If the coefficients a11 to a77 are 1, the reflected electrons of their pixels are shielded by the spacer.

If the spacer is located at the position E in FIG. 6, pixels whose reflected electrons are shielded by the spacer move above the spacer. In this case, the coefficients a11 to a77 turns as shown in FIG. 8E. Likewise, if the spacer is located at the position F, the coefficients a11 to a77 turn as shown in FIG. 8F. If the spacer is located at the position G, the coefficients a11 to a77 turn as shown in FIG. 8G.

Change-over of the aforementioned coefficients is carried out in a blank period within the horizontal synchronous period. This change-over operation is the same as the second embodiment.

By the above-mentioned processing, correction of the proximity of the spacer is carried out by applying data of the quantity of reflected electrons corresponding to halation, shielded by the spacer to the noteworthy pixel as image data. As a consequence, a difference of image quality between the proximity of the spacer and the non-proximity of the spacer can be reduced.

Fourth Embodiment

In the second embodiment and third embodiment, correction considering the shielding operation of electrons by the spacer is executed. On the other hand, in the spacer, an operation of reflecting electrons or emitting secondary electrons by impinging of electrons can be generated. In a light emission area corresponding to the electron emitting element of the noteworthy pixel, electron originating from an electron emitted by the electron emitting element or an electron emitting element located on the same side as that electron emitting element with respect to the spacer (electron reflected in the light emitting area to which the electron emitted from the electron emitting element corresponding or in addition to that, electron itself emitted from the electron emitting element and not impinging to neither of them) impinges upon the spacer and consequently, reflection by the spacer or emission of secondary electron occurs, so that as it impinges on the light emission area of the noteworthy pixel, the quantity of light emission of the noteworthy pixel increases. Although this operation is not large, more appropriate correction can be carried out by executing correction considering this operation.

More specifically, a circuit having the same structure as the proximity data integrating portion 20, the coefficient computing portions 7R, 7G, 7B and the adder 6 used in the structure of FIG. 1 is provided as a circuit for evaluating an increase in the quantity of light emission by the spacer. The integrating portion integrates data of a element in which an influence of reflected electron (including secondary electron) by the spacer may be generated in the noteworthy pixel when emitting electrons. For each integrated value, the coefficient of each color is computed by means of the same circuit as the coefficient computing portion of FIG. 1. The coefficient for use here is obtained by multiplying the coefficient of each color (may be the same value as the coefficients $k_R$, $k_G$, $k_B$ used in the first to third embodiments) with a coefficient (0.0166 is adopted here) indicating the degree of reflection in the spacer. 0.00025 is used for red, 0.0002 is used for green and 0.0003 is used for blue. Data multiplied with this coefficient is added by the adder 6 and that value is used as a correction value for compensating an increase of the quantity of light emission of the noteworthy pixel due to reflection by the spacer. More specifically, this correction value is subtracted from data of the noteworthy pixel. In the meantime, this correction is carried out together with the corrections of the second embodiment and third embodiment.

According to the above-described respective embodiments, an image display apparatus capable of obtaining an excellent light emission state and a correction method of a drive signal of the electron emitting element for use in image display can be achieved.

Figure 9:
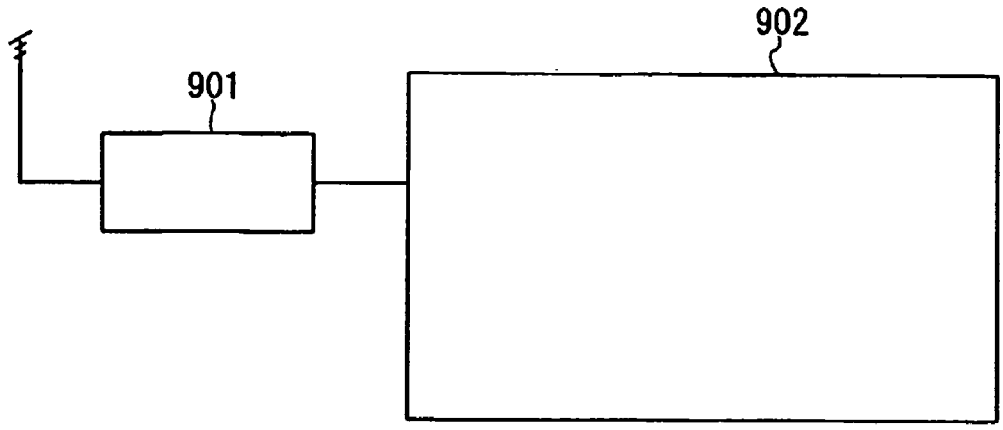
FIG. 9 is a diagram showing the structure of a television apparatus using an image display apparatus.

FIG. 9 is a diagram showing the structure of a TV unit using the image display apparatus described above.

A receiving circuit 901 receives a TV signal inputted through an antenna, generates a signal for reproducing TV broadcasting and outputs it to an image display apparatus 902.

According to the present invention, an effect that excellent image display can be achieved is secured.

This application claims priority from Japanese Patent Application No. 2004-365532 filed Dec. 17, 2004, which is hereby incorporated by reference herein.

What is claimed is:

1. An image display apparatus comprising:

a plurality of pixels each having an electron emitting element and a light emitting area to be irradiated by electrons from the electron emitting element; and a driving circuit for outputting a driving signal that drives the electron emitting element, wherein the plurality of the light emitting areas include a plurality of light emitting areas that respectively emit light of different colors, wherein said driving circuit includes a correction circuit for correcting an input signal, and wherein said correction circuit executes a correction to the input signal corresponding to a predetermined electron emitting element based on a value obtained by adjusting a value corresponding to a quantity of electrons emitted from a proximate electron emitting element proximate to the predetermined electron emitting element, with a value corresponding to the light emitting color of the light emitting area which is possessed by the pixel to which the proximate electron emitting element belongs, wherein said image display apparatus further comprises a shielding member which suppresses incidence of electrons which is caused by electrons emitted by the electron emitting elements upon a light emitting area other than the light emitting area corresponding to the electron emitting elements, and wherein the correction to the input signal corresponding to the predetermined electron emitting element proximate to said shielding member, is carried out based on a value obtained by adjusting a value corresponding to a quantity of electrons emitted by the proximate electron emitting element, incidence of electrons which is caused by electrons emitted by the proximate electron emitting element upon the light emitting area corresponding to the predetermined electron emitting element being suppressed by said shielding member, with a value corresponding to light emission color of the light emitting area which is possessed by the pixel to which the proximate electron emitting element belongs.

2. An image display apparatus according to claim 1, wherein the correction to the input signal corresponding to the predetermined electron emitting element is carried out based on a value obtained by adjusting each value corresponding to a quantity of electrons emitted by each of plurality of electron emitting elements proximate to the predetermined electron emitting element, incidence of electrons which is caused by electrons emitted by each of the proximate electron emitting elements upon the light emitting area corresponding to the predetermined electron emitting element being suppressed by said shielding member, with a value corresponding to each light emission color of each light emitting area which is possessed by each pixel to which each of the proximate electron emitting elements belongs.

3. An image display apparatus according to claim 1, wherein the correction to the input signal corresponding to the predetermined electron emitting element is a correction, in which the quantity of light emission obtained by the input signal corrected based on the adjusted value is larger than a quantity of light emission obtained by the input signal to which the correction is not executed.

4. An image display apparatus according to claim 1, wherein the correction to the input signal corresponding to a predetermined electron emitting element proximate to said shielding member, further includes a correction executed based on a value obtained by adjusting a value corresponding to a quantity of electrons emitted by a specific proximate electron emitting element, with a value corresponding to the light emitting color of the light emitting area possessed by the pixel to which the proximate electron emitting element belongs, and said specific proximate electron emitting element being proximate to the predetermined electron emitting element, incidence of electrons which is caused by electrons emitted by the specific proximate electron emitting element upon a light emitting area corresponding to the predetermined electron emitting element being not suppressed by said shielding member, and incidence of electrons which is caused by the incidence of the electrons emitted by the specific proximate electron emitting element upon said shielding member are incident upon a light emitting area corresponding to the predetermined electron emitting element.

5. An image display apparatus according to claim 4, wherein the correction executed based on the value obtained by adjusting the value corresponding to the quantity of electrons emitted by the specific proximate electron emitting element, with the value corresponding to the light emitting color of the light emitting area which is possessed by the pixel to which the proximate electron emitting element belongs, is a correction in which the quantity of light emission obtained by the input signal corrected based on the adjusted value is smaller than a quantity of light emission obtained by the input signal to which the correction is not executed.

6. A television apparatus comprising:

a receiving circuit for receiving a television signal; and an image display apparatus according to claim 1 for executing a display based on a signal received by the receiving circuit.

* * * * *